US005457482A

United States Patent [19]

Rhoden et al.

[11] Patent Number: 5,457,482

[45] Date of Patent: Oct. 10, 1995

[54] METHOD AND APPARATUS FOR UTILIZING OFF-SCREEN MEMORY AS A SIMULTANEOUSLY DISPLAYABLE CHANNEL

[75] Inventors: Desi Rhoden, Boulder; Darel N. Emmot, Ft. Collins, both of Colo.

[73] Assignee: Hewlett Packard Company, Palo Alto, Calif.

[21] Appl. No.: 254,449

[22] Filed: Jun. 6, 1994

Related U.S. Application Data

[63] Continuation of Ser. No. 142,798, Oct. 25, 1993, abandoned, which is a continuation of Ser. No. 670,083, Mar. 15, 1991, abandoned.

[51] Int. Cl.[6] ..... G09G 1/02

[52] U.S. Cl. ..... 345/201; 345/185

[58] Field of Search ..... 345/201, 185, 345/203, 200, 202, 196, 197, 198

[56] References Cited

U.S. PATENT DOCUMENTS

| | | | |
|---|---|---|---|
| 4,496,976 | 1/1985 | Swanson et al. | 340/799 |
| 4,688,190 | 8/1987 | Bechtolsheim | 340/799 |
| 4,742,474 | 5/1988 | Knierim | 340/799 |
| 4,796,231 | 1/1989 | Pinkham | 340/799 |
| 4,876,663 | 10/1989 | McCord | 340/750 |
| 4,882,710 | 11/1989 | Hashimoto et al. | 340/799 |
| 4,910,505 | 3/1990 | Beaven et al. | 340/799 |
| 4,991,110 | 2/1991 | Hannah | 340/750 |

OTHER PUBLICATIONS

Rogers, D. F. *Procedural Elements For Computer Graphics* N.Y., McGraw–Hill, 1985 pp. 3–15.

*Primary Examiner*—Ulysses Weldon
*Assistant Examiner*—Xiao M. Wu

[57] ABSTRACT

A method and apparatus for the storage and retrieval of pixel information, including first and second data portions, is shown to include first and second memory devices each having a random access memory and a shift register, wherein the random access memory includes an on screen section and an off screen section. Pixel information is retrieved from the random access memories in response to control signals and transferred to the shift registers. A controller controls the storage and retrieval of the first data portion in the on screen section of the first memory device, controls the storage and retrieval of the second data portion in the off screen section of the second memory device and generates the control signals so that the first and second data portions are outputted from the shift registers simultaneously.

14 Claims, 3 Drawing Sheets

METHOD AND APPARATUS FOR UTILIZING OFF-SCREEN MEMORY AS A SIMULTANEOUSLY DISPLAYABLE CHANNEL

CROSS REFERENCE TO RELATED APPLICATIONS

This is a continuation of application Ser. No. 08/142,798 filed on Oct. 25, 1993, which is a continuation of application Ser. No. 07/670,283, filed on Mar. 15, 1991, now both abandoned.

FIELD OF THE INVENTION

The present invention relates generally to the field of computer graphics display systems and, more particularly, to those devices and techniques used in raster graphics systems for the storage and provision of pixel information to and from a frame buffer.

BACKGROUND OF THE INVENTION

Computer graphics systems are now available which allow the researcher to study or view various types of data as three dimensional images on a display screen. Of the three types of graphics systems available, namely, storage tube, calligraphic and raster, the present invention finds particular use in the latter. In raster graphics systems, the display screen can be thought of as an XY grid pattern. Each discrete cell or element in the grid pattern is referred to as a pixel, i.e. picture element. In raster graphics systems, each pixel can be displayed in a desired manner, i.e. brightness, color, etc. See Rogers, D. F. *Procedural Elements for Computer Graphics*. N.Y., McGraw-Hill, 1985, pp. 3–15. Due to such versatility, raster graphics systems have become quite popular.

In general, a raster graphics system includes an image creation section, an image storage section, an image display section and a raster display which can be of several types, including a cathode ray tube (CRT). In such a raster graphics system, the image creation section converts signals generated by one or more applications (computer programs) into pixel information which is stored in a frame buffer. Information relating to each pixel is written to a particular memory location in the frame buffer for eventual screen display. Such memory locations are referred to as "on screen" memory, which typically forms only a part of the overall frame buffer memory. Memory locations to which pixel information is not written are referred to as "off screen" memory. Pixel information is read from the frame buffer and provided to the image display section where the digital data is converted to one or more analog signals. The analog signals are designed to achieve the desired pixel image when applied to the raster display.

It will be understood that if the raster display is a CRT, the image displayed on the CRT must be updated (refreshed) at least 30 times per second in order for the eye to perceive a continuous picture. Consequently, the time required to access pixel information stored in the on screen portion of the frame buffer is critical to raster graphics systems incorporating CRT displays. For example, in the case of a 512×512 raster display, if pixels are accessed individually with an average access time of 200 nanoseconds, then it requires 0.0524 seconds to access each pixel from a 512×512 on screen memory. This is equivalent to a refresh or frame rate of approximately 19 frames per second, well below the required minimum refresh rate of 30 frames per second. The average access time must be quicker. As the number of pixels increases, i.e. increased resolution, the rate at which pixels are accessed becomes even more critical.

More realistically, the on screen memory portion of the frame buffer of a contemporary raster graphics system will include a twenty four bit-plane memory, where eight bit-planes are dedicated to each CRT primary color, i.e. red, green and blue. A bit-plane is a quantity of contiguous memory equal to the number of pixels in the raster display. For example, a 512×512 raster display will have a total of 262,144 bits. Each bit plane in such a system will include this same amount of memory.

In a twenty four bit-plane graphics system, approximately 188,743,680 bits per second must be accessed from the frame buffer to achieve a refresh rate of thirty frames per second. Since physically independent memory devices are utilized in the frame buffer for each CRT color (red, green, blue), only 62,914,560 bits need be accessed each second for any one color.

In many cases it is desired to increase the number of lines in the display as well as the number of pixels per line. If it is desired to increase the 512×512 raster display to a 1024×1024 raster display or greater, it will be necessary to access approximately 125,829,120 bits per second for each color.

In order to handle such large access operations particular memory devices and techniques have been utilized, for example memory devices in which eight bits of information can be retrieved at any single row and column address and the retrieval of pixel information in groups.

Since the access rate of pixel information is critical, it is important that the bandwidth of the frame buffer be maximized. As used herein, frame buffer bandwidth shall mean the number of bits per second which can be transferred from the frame buffer to the image display section of the graphics system. In other words, bandwidth equals the number of frame buffer memory locations that can be accessed per second. It will be appreciated that frame buffer bandwidth/access time will directly effect the degree of resolution which can be achieved.

U.S. Pat. No. 4,991,110—Hannah recognizes the need to increase memory bandwidth in a graphics device. The frame buffer memory is said to include a plurality of video random access memory (VRAM) devices. VRAM devices are memory devices specifically designed for the temporary data storage conditions occurring in graphics applications. Bandwidth of the random port is said to be increased by staggering the timing of row address strobe signals and column address strobe signals so that data can be transferred in a staggered fashion to each VRAM within a memory cycle. Pixel information is stored in a sequential fashion. Read operations are also said to be enhanced utilizing a staggered output enable signal.

Unfortunately, frame buffers utilizing VRAM devices exhibit bandwidth limited by the rate at which information can be shifted out of the shift register component of the VRAM devices. That is, bandwidth is limited by the number of data shifts required to access the desired pixel information stored in the VRAMs. However, VRAMs do have other desireable qualities.

Consequently, a need exists for a raster graphics system which utilize a frame buffer incorporating VRAM devices and which exhibit maximum frame buffer bandwidth.

SUMMARY OF THE INVENTION

A new and novel method and apparatus for the storage and retrieval of pixel information, including first and second data portions, is shown to include first and second memory devices each having a random access memory and a shift register, wherein the random access memory includes an on screen section and an off screen section. Pixel information is retrieved from the random access memories in response to control signals and transferred to the shift registers. A controller controls the storage and retrieval of the first data portion in the on screen section of the first memory device, controls the storage and retrieval of the second data portion in the off screen section of the second memory device and generates the control signals so that the first and second data portions are outputted from the shift registers simultaneously.

In a preferred embodiment, pixel information is stored in a scan line format. In such an embodiment the first memory device is defined to store pixel information for a first scan line in the on screen section and the second memory device is defined to store pixel information for a subsequent scan line in the on screen section. The controller operates to store the second data portion representative of pixels in the first scan line in the off screen section of the second memory device.

In a still further embodiment, the controller generates addresses for the storage of the first and second data portions such that the first and second memory devices are divided into a plurality of zones. It also preferred to generate the second address by adding a third address representative of a predetermined number of zones to the first address. In a further alternate embodiment, each addressable location in the first and second memory devices is N bits in length and the second data portion is M bits in length, wherein M is less than N. In such situations the controller selectively rotates the second data portion so that the second data portion is contained in either the first or last M bits of the addressable location.

BRIEF DESCRIPTION OF THE DRAWINGS

The present invention will be better understood, and its numerous objects and advantages will become apparent to those skilled in the art by reference to the following detailed description of the invention when taken in conjunction with the following drawings, in which.

DETAILED DESCRIPTION OF THE PREFERRED EMBODIMENT

Figure 1:
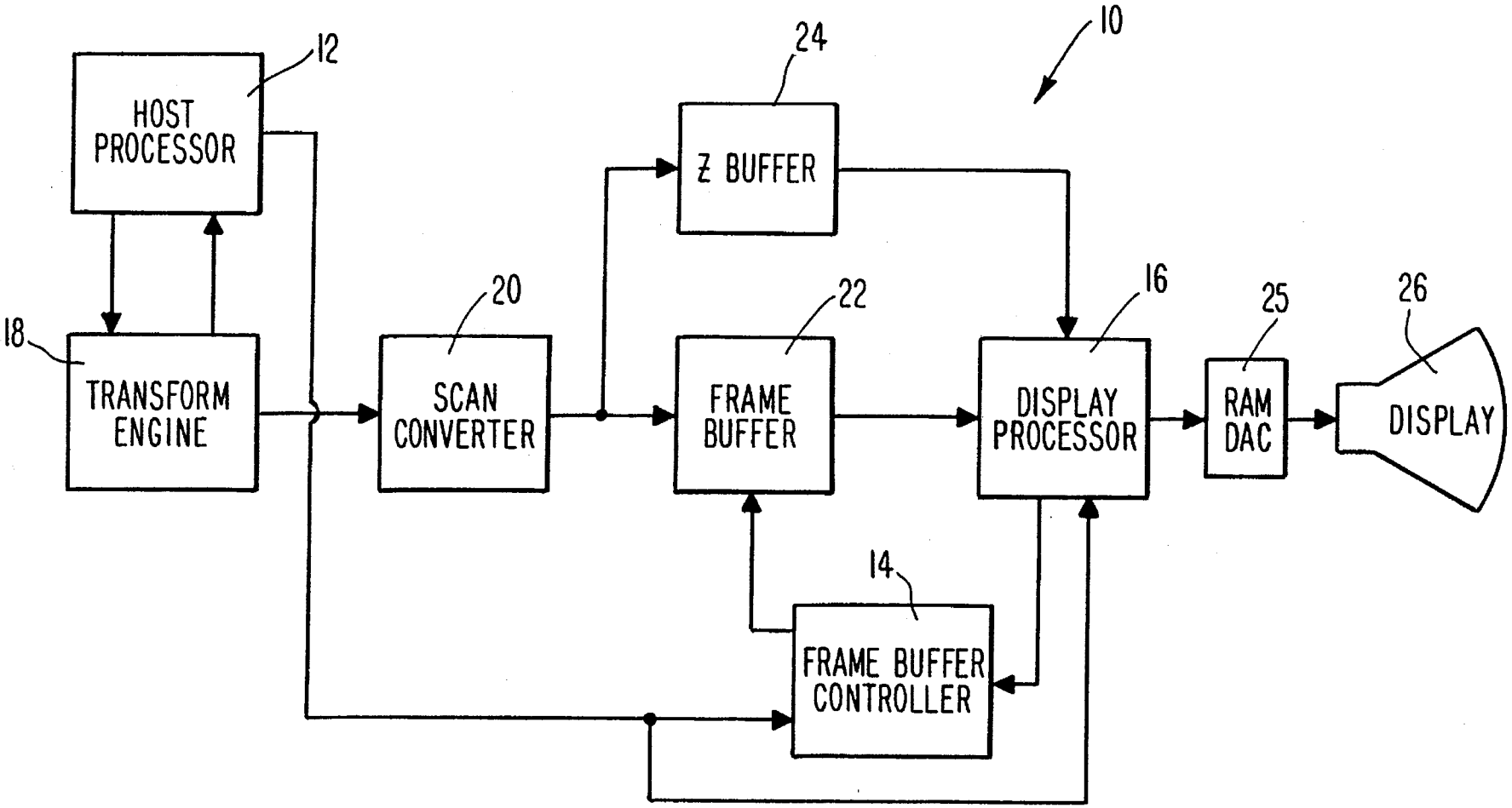
FIG. 1 is block diagram of a computer graphics system constructed in accordance with the present invention.

A new and novel graphics system is shown in FIG. 1 and generally designated 10. Graphic system 10 is shown to include a host processor which generates graphics commands as well as providing a display signal generated by the application or applications in operation in the computer. The graphics commands are provided to frame buffer controller 14 and display processor 16. The display signal is provided to a transform engine 18. The display signal, which at this point is primarily mathematical representations, is transformed into pixel information. It will be noted that in the preferred embodiment pixel information includes image information (color information), overlay data, window identification data and display mode data. As will be described in greater detail hereafter, the image information preferably includes twenty four bits while the overlay window identification and display mode data each include four bits.

The pixel information generated by transform engine 18 is provided to scan converter 20 which converts the pixel information into scan line format. In other words, the information relating to each pixel is ordered such that each pixel is arranged in scan line sequence. The converted pixel information is thereafter provided to frame buffer 22 and Z buffer 24. Pixel information is stored in and read from frame buffer 22 in response to control signals generated by frame buffer controller 14. Pixel information read from frame buffer 22 and Z buffer 24 is provided to display processor 16 which formats pixels into their correct display formats based upon display mode information stored in frame buffer 22. Correctly formatted pixel information is provided to random access memory (RAM) digital to analog converter (DAC) 25, which in the preferred embodiment includes a color look up table and which converts pixel information from digital form to a series of analog signals designed to achieve the desired pixel image on color display 26. In the preferred embodiment, such analog signals include an analog signal for each color gun (not shown) of display 26, i.e., red, green and blue, and an analog signal representative of $\alpha$ information.

Figure 2:
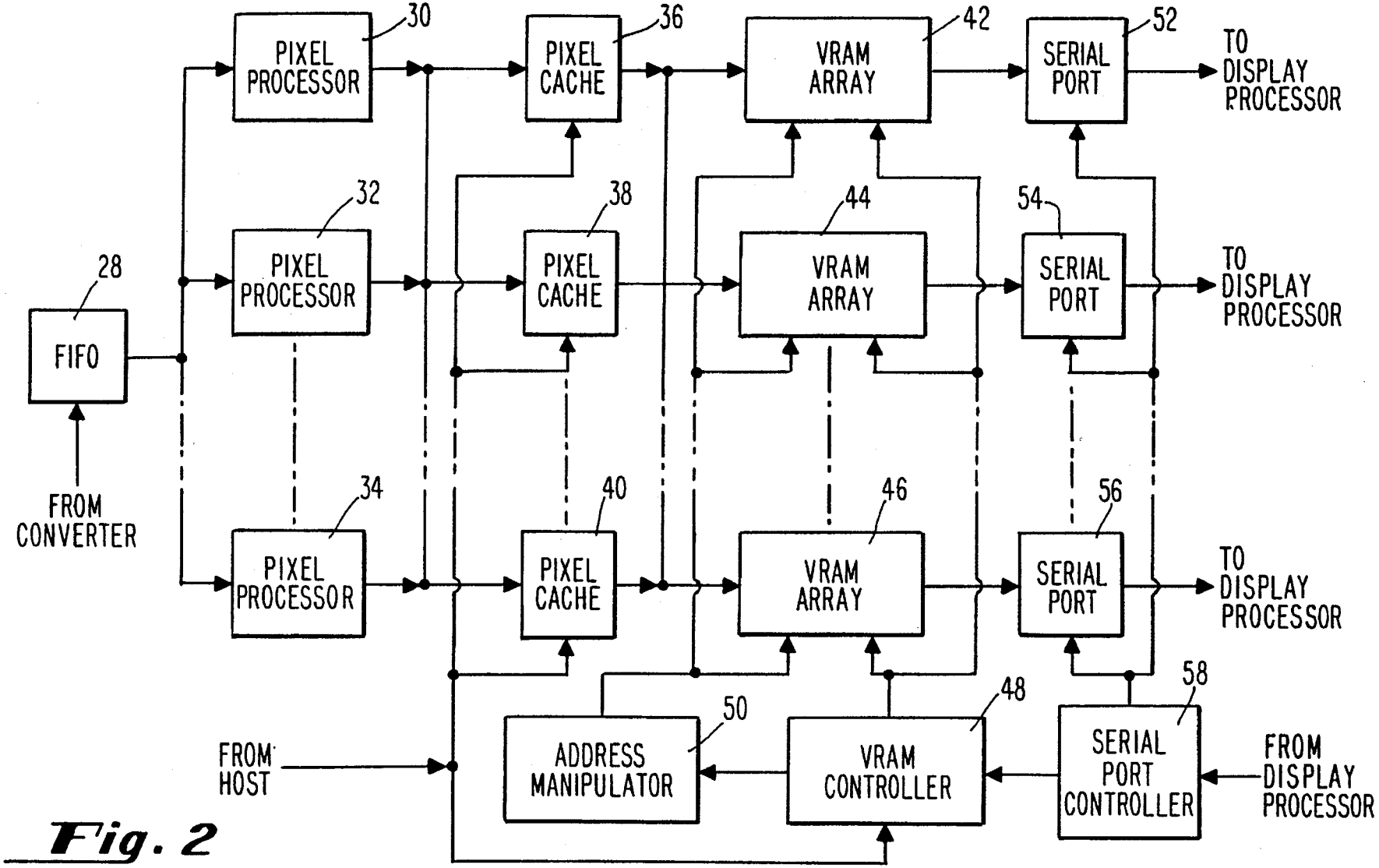
FIG. 2 is a more detailed block diagram of the frame buffer and frame buffer controller depicted in FIG. 1.

Referring now to FIG. 2, frame buffer 22 and frame buffer controller 14 will be more particularly described. As shown in FIG. 2, pixel information provided by scan converter 20 is supplied to a first-in-first-out (FIFO) processor 28. FIFO 28 acts as a temporary buffer for pixel information and provides the buffered pixel information to pixel processors 30, 32 and 34. In the preferred embodiment there are four pixel processors, only three are depicted. Each pixel processor processes pixel information representative of image data, i.e., color and intensity data, Z buffer data and $\alpha$ data for a given scan line. Since four pixel processors are utilized, up to four scan lines of data can be processed. Window, overlay and display data, as will be described herein is not processed by the pixel processors, but rather is stored in the frame buffer during non-rendering operations.

Pixel processors 30, 32 and 34 each read pixel information from FIFO 28 simultaneously and it is preferred that the beginning of each read operation does not start until all pixel processors are ready to read information from FIFO 28, i.e. until all pixel processors have completed processing data associated with a given scan line. While all pixel processors operate on the same commands and data in parallel from FIFO 28, each processor restricts itself to only those pixels which have pre-determined addresses (scan lines) associated with the particular processor. Once a read operation is begun, it is preferred that each pixel processor output pixels at its own rate. Each of the pixel processors operates to output pixels along a given logical scan line, also referred to as a span.

Pixel information output by pixel processors 30, 32 and 34 is provided to pixel caches 36, 38 and 40. Although the pixel caches will be generally described herein, such pixel caches are more particularly described in application Ser. No. 495,005, filed Mar. 16, 1990 and entitled "Arithmetic And Logic Processing Unit For Computer Graphics System" which is hereby incorporated by reference. Such pixel caches are also more particularly described in application Ser. No. 669,801 filed Mar. 15, 1991, entitled "Data Rotator Means" which is hereby incorporated by reference.

Similar to pixel processor 32, pixel cache 38 is preferably utilized in relation to pixel information representative of a single color, namely, red. Separate pixel caches (not shown) will preferably be utilized for each of the other primary colors (green and blue).

Pixel caches 36, 38 and 40 act as the caches of pixels between the bulk storage devices of frame buffer 22 and pixel processors 30, 32 and 34. Each pixel cache can hold several tiles, i.e., a 1×4 group of pixels. Basically, the pixel caches accept pixel information associated with a logical scan line and operate to place this data at a physical scan line location related to display 26. Data are addressed within pixel caches 36, 38 and 40 via logical addresses, however, such pixel information is written into bulk storage using physical addresses.

Pixel information provided by pixel caches 36, 38 and 40 are supplied to VRAM arrays 42, 44 and 46. As will be described in greater detail herein, each VRAM array comprises a plurality of individual VRAM devices. In the preferred embodiment, each VRAM device is a 128K×8 device. It will be understood that each VRAM device will contain 8 bits of pixel information for a given pixel. It is also preferred that the VRAM devices be arranged in a 4×4 matrix. In other words, each VRAM array 42, 44 and 46 contain sixteen individual VRAM devices arranged in a 4×4 matrix.

The storage and retrieval operations of pixel information in relation to VRAM arrays 42, 44 and 46 is controlled by VRAM controller 48 and address manipulator 50. Pixel information read from VRAM arrays 42, 44 and 46 are provided to serial port devices 52, 54 and 56. Serial ports 52, 54 and 56 act as a collection point for pixel information so that all information relating to a particular pixel can be provided to display processor 16 simultaneously. The operation of serial ports 52, 54 and 56 are directed by serial port controller 58.

Figure 3:
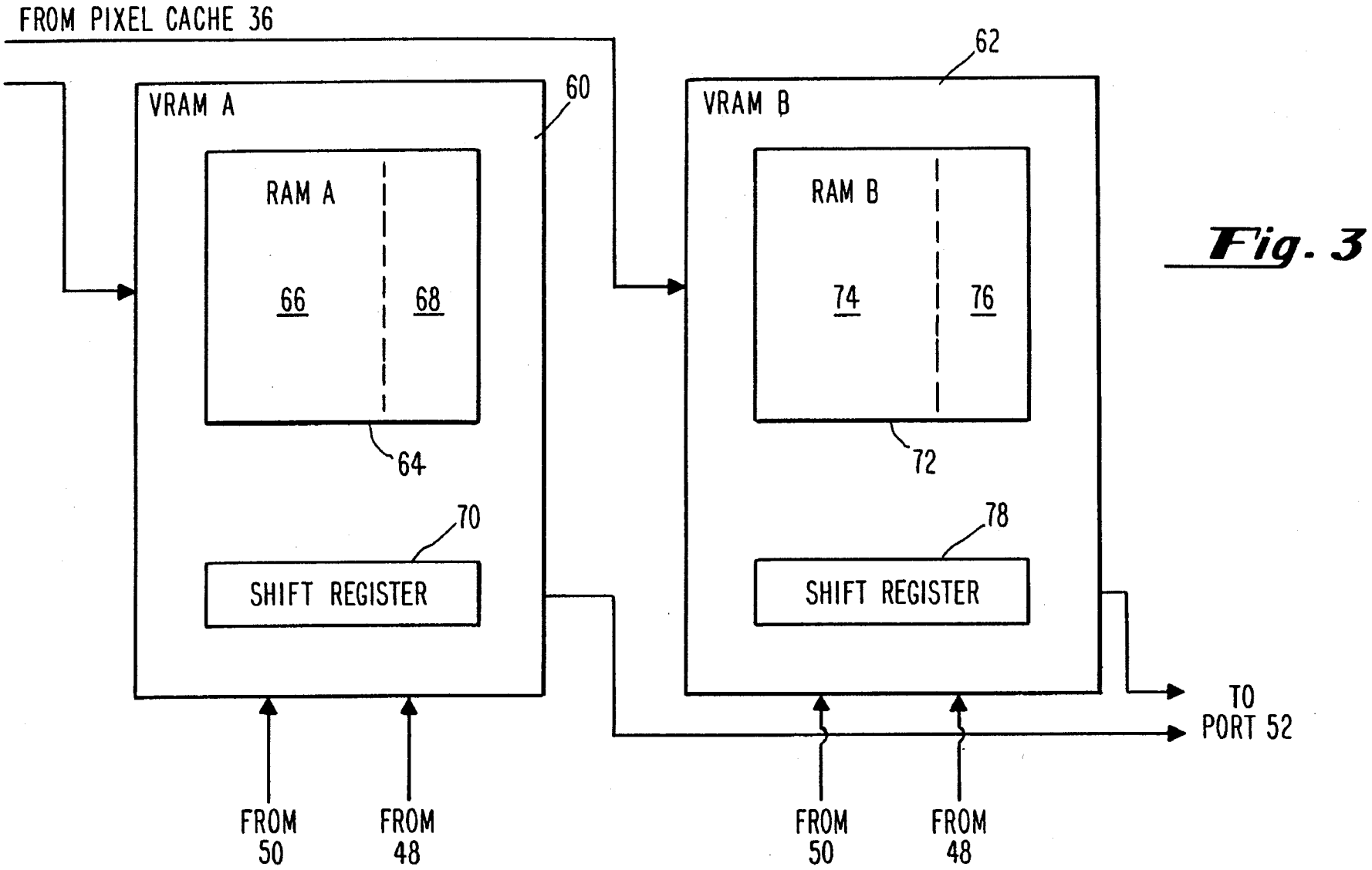
FIG. 3 is a more detailed block diagram of a portion of a VRAM array depicted in FIG. 2.

Referring now to FIG. 3, a more detailed description of VRAM arrays 42, 44 and 46 will be given. As shown in FIG. 3, two of the sixteen VRAM devices are depicted. For purposes of illustration, this description will be in relation to VRAM array 42, however, it will be noted that each VRAM array is constructed substantially identically. VRAM array 42 is shown to include VRAM devices 60 and 62. Device 60 has been designated VRAM A and device 62 has been designed VRAM B. Information from pixel cache 36 is provided simultaneously to the inputs of VRAM A and VRAM B. Control signals provided by VRAM controller 48 and address manipulator 50 will determine whether pixel information presented to the input of VRAM A or VRAM B is actually stored therein. It will also be noted that the designations A and B are meant to identify subsequent scan lines. In other words, pixel information stored in VRAM A will appear on scan line A while pixel information stored in VRAM B will appear on scan line B.

For purposes of the present invention, pixel information can be viewed as having first and second data portions. In the preferred embodiment, the first data portion constitutes data associated with image, Z buffer or $\alpha$ data for a particular pixel. The second data portion constitutes attribute data, which basically is an indication of how image data has been encoded by the graphics system, i.e. display mode data. It will be necessary to retrieve the attribute data in order to render a given pixel. Since the second data portion is only necessary during rendering and since attribute data is known in advance of most rendering operations, such data portion is preferably stored during a non-rendering operation. By "pre-storing" such data, the bandwidth during rendering for storing image data in VRAM arrays 44 and 46 will be enhanced as will be appreciated below.

VRAM 60 is shown to include a random access memory portion 64, which random access memory 64 includes an on-screen section 66 and an off-screen section 68. Pixel information is retrieved from random access memory 64 in response to the control signals provided VRAM controller 48 and address manipulator 50 and such retrieved pixel information is transferred from random access memory 64 to shift register 70.

Similarly, VRAM 62 includes a random access memory portion 72 which random access memory 72 includes an on-screen section 74 and an off-screen section 76. Pixel information is retrieved from random access memory 72 in response to control signals from VRAM controller 48 and address manipulator 50 and such retrieved pixel information is transferred to shift register 78.

The control signals generated by VRAM controller 48 and address manipulator 50 operate to control the storage of the first data portion of pixel information in the on-screen section of random access memory 64 and 72 during rendering operations and further operate to store the second data portion of the pixel information in the off-screen sections 68 and 76 of random access memory 64 and 72, respectively during non-rendering operations.

In accordance with the invention, the control signals provided by VRAM controller 48 and address manipulator 50 operate such that the first data portion of pixel information relating to a particular pixel is stored in on-screen section 66. The second data portion relating to that same pixel is stored in off-screen portion 76. In other words, during rendering operations, the first data portions of pixel information relating to pixels found in scan line A are stored in on-screen section 66. The second data portions relating to those same pixels are stored during non-rendering operations in off-screen section 76. It will be recalled that off-screen section 76 is contained in random access memory 72 generally designated for scan B pixel information.

It will be understood from the above that pixel information is stored in frame buffer 22 in scan line format such that pixel information representative of pixels included in scan line A are stored in VRAM 60 while pixel information representative of pixels included within a subsequent scan line (scan line B) are stored in VRAM 62. Frame buffer controller 14, via VRAM controller 48 and address manipulator 50 is operative to store the second data portion representative of pixels in scan line A in second off-screen section 76.

In the preferred embodiment, address manipulator 50 generates addresses for storage of the first and second data portions. The address generated by address manipulator 50, are operative to effectively divide random access memory 64 and 72 into a plurality of zones. In operation, each zone is provided a particular row address strobe signal in order to retrieve data within that zone. It will be noted that the first data portion of the pixel information is stored at an address in one of the zones included within on-screen section 66 and 74 while the second data portion is stored at second address in one of the zones included within off-screen sections 68 and 76.

In the preferred embodiment, address manipulator 50 generates the address from the second data portion by adding a third address to the first address wherein the third address is representative of a predetermined number of zones by which the first address will be offset. In the preferred embodiment, address manipulator 50 divides random access memory 64 and 72 into eight zones, wherein on-screen sections 66 and 74 comprise the first five zones and off-screen sections 68 an 76 comprise the last three zones. It is especially preferred that the third address, which is added to the first address as an offset for the second data portion, be equal to five zones of offset if the first address lies within the first three zones of the on-screen section 66 or 74 and it is especially preferred that the third address be representative of three zones of offset if the first address lies within the fourth or fifth zones of on-screen sections 66 and 74.

In the preferred embodiment, each addressable location in VRAM devices 60 and 62 for the storage of pixel information is N bits in length, where N is equal to 8. It is also preferred that the second data portion be equal to M bits in length, where M is equal to 4. It will be appreciated from the above that with five zones of on-screen memory locations and three zones of off-screen memory locations, it will be necessary to place certain data portions at the same off-screen section address. It will be recalled that each address location is 8 bits in length. In accordance with the present invention, certain of the second data portion is stored in the first four bits at an off-screen address while the second data portion associated with other pixels is located in the last four bits of the off-screen address. In order to accomplish such storage, it will be necessary to rotate the second data portion. Rotation of the second data portion is carried out by rotation circuitry included within each of the pixel caches 36, 38 and 40. A more detailed description of such devices and their operations is contained in previously referenced application Ser. No. 669,801 (Attorney Docket Number 189364). Rotation of the second data portion will occur in relation to the following condition. The second data portion will be contained in the first N bits of the off-screen location if the third address, i.e., that address added to the first address to generate the off-screen address, is representative of five zones of offset. The second data portion is contained in the last M bits of the off-screen location if the third address is representative of three zones of offset.

It is noted that by storing the second data portion during non-rendering operations each of the scan A and scan B VRAMs can be accessed concurrently during a rendering operation, resulting in increased bandwidth during image data storage operations.

While the invention has been described and illustrated with reference to specific embodiments, those skilled in the art will recognize that modification and variations may be made without departing from the principles of the invention as described herein above and set forth in the following claims.

What is claimed is:

1. A method for the storage and retrieval of pixel information in a computer graphics system, wherein the pixel information representative of each pixel comprises first and second data portions, said first data portion indicative of image data, said second data portion indicative of attribute data, said method comprising the steps of:

providing a first memory device for storage of said pixel information comprising a first random access memory and a first shift register, wherein said first random access memory comprises a first on-screen section and a first off-screen section and wherein pixel information is retrieved from said first random access memory in response to a first control signal and transferred from said first random access memory to said first shift register;

providing a second memory device for storage of said pixel information comprising a second random access memory and a second shift register, wherein said second random access memory comprises a second on-screen section and a second off-screen section and wherein pixel information is retrieved from said second random access memory in response to a second control signal and transferred from said second random access memory to said second shift register;

storing said first data portion in said first on-screen section;

storing said second data portion in said second off-screen section; and generating said first and second control signals, wherein during retrieval first and second data portions, representative of pixel information relating to a particular pixel, are outputted from said first and second shift registers simultaneously.

2. The method of claim 1, wherein said steps of providing said first and second memory devices comprises providing video random access memory devices.

3. The method of claim 2, wherein said pixel information is stored in said frame buffer in a scan line format wherein said step of controlling the storage of said first data portion in said first on screen section comprises storing pixel information in said first on screen section representative of pixels included within a first scan line and wherein said second memory device is defined to store pixel information representative of pixels included within a subsequent scan line and wherein said step of controlling the storage of said second data portion comprises storing pixel information representative of pixels in said first scan line in said second off screen section of said second memory device defined to store said subsequent scan line.

4. The method of claim 3, wherein said step of controlling the storage of said first and second data portions comprises the steps of generating addresses for said first and second data portions, wherein said first and second random access memories are divided by the addresses into a plurality of zones, so that said first data portion is stored at a first address in one of the zones associated with said first on screen section and said second data portion is stored at a second address in one of the zones associated with said second off screen memory section.

5. The method of claim 4, wherein said step of generating said second address for said second data portions comprises the step of adding a third address representative of a predetermined number of zones to said first address.

6. The method of claim 5, wherein said step of generating addresses for said first and second data portions comprises the step of dividing said first and second random access memories into eight zones, wherein said on screen memory comprises the first five zones and wherein said off screen memory comprises the last three zones.

7. The method of claim 6, wherein said third address is representative of five zones if said first address lies within the first three zones and wherein said third address is representative of three zones if said first address lies within the fourth and fifth zones.

8. The method of claim 7, wherein each addressable location in said first and second memory devices for the storage of pixel information is N bits in length and wherein said second data portion is M bits in length, wherein M is less than N, further comprising the step of selectively rotating said second data portion prior to storage in said second off screen memory section, wherein said second data portion is contained in the first M bits if said third address is representative of five zones and wherein said second data portion is contained in the last M bits if said third address is representative of three zones.

9. The method of claim 8, wherein N is equal to eight and wherein M is equal to four.

10. A frame buffer for use in a computer graphics system for the storage and retrieval of pixel information wherein the pixel information representative of each pixel comprises first and second data portions, said first data portion indicative of image data, said second data portion indicative of attribute data, said frame buffer comprising:

a first random access memory;

a first on-screen section residing within said first random access memory, said first on-screen section stores said first data portion indicative of image data;

a first off-screen section residing within said first random access memory;

a first shift register coupled to said first random access memory, which receives said first data portion from said first on-screen section residing within said random access memory in response to a first control signal;

a second random access memory, separate from said second random access memory;

a second on-screen section residing within said second random access memory;

a second off-screen section residing within said second random access memory, said second off-screen section stores said second data portion indicative of attribute data;

a second shift register coupled to said first random access memory, which receives said second data portion from said second off-screen section residing within said second random access memory in response to a second control signal; and a controller, connected to said first and second random access memories, which generates said first and second control signals, wherein first and second data portions, representative of pixel information relating to a particular pixel, are outputted from said first and second shift registers simultaneously.

11. The frame buffer of claim 10, wherein said pixel information is stored in said frame buffer in a scan line format.

12. The frame buffer of claim 11, wherein said controller further comprises an address generator which generates addresses for said first and second data portions, wherein said first and second random access memories are divided by the generated addresses into a plurality of zones so that said first data portion is stored at a first address in one of the plurality of zones and said second data portion is stored at a second address in another of the plurality of zones.

13. The frame buffer of claim 12, wherein said controller divides said first and second random access memories into eight zones, wherein in said on-screen memory comprises the first five zones and wherein said off-screen memory comprises the last three zones.

14. A computer graphics system, comprising:

a host processor for generating a desired digital information signal;

a transform engine, connected to said host processor, for converting said information signal into a screen coordinate data signal;

a scan converter, connected to said transform engine, for converting said screen coordinate data signal into pixel information arranged in scan line format;

a display processor for converting pixel information presented in scan line format into an analog signal suitable for display on a display device; and a frame buffer, connected between said scan converter and said display processor, for storage and retrieval of pixel information in scan line format wherein the pixel information representative of each pixel comprises first and second data portions, said frame buffer comprising: a first random access memory;

a first on-screen section residing within said first random access memory, said first on-screen section stores said first data portion indicative of image data;

a first off-screen section residing within said first random access memory;

a first shift register coupled to said first random access memory, which receives said first data portion from said first on-screen section residing within said random access memory in response to a first control signal;

a second random access memory, separate from said second random access memory;

a second on-screen section residing within said second random access memory;

a second off-screen section residing within said second random access memory, said second off-screen section stores said second data portion indicative of attribute data;

a second shift register coupled to said first random access memory, which receives said second data portion from said second off-screen section residing within said second random access memory in response to a second control signal; and a controller, connected to said first and second random access memories, which generates said first and second control signals, wherein first and second data portions, representative of pixel information relating to a particular pixel, are outputted from said first and second shift registers simultaneously.

* * * * *